US009810481B2

(12) United States Patent
Ennen et al.

(10) Patent No.: US 9,810,481 B2
(45) Date of Patent: Nov. 7, 2017

(54) DISHWASHER AND METHOD FOR OPERATING A DISHWASHER

(71) Applicant: MIELE & CIE. KG, Guetersloh (DE)

(72) Inventors: Guenther Ennen, Enger (DE); Martin Kornberger, Bielefeld (DE); Stefan Tiekoetter, Bielefeld (DE)

(73) Assignee: MIELE & CIE. KG, Guetersloh (DE)

( * ) Notice: Subject to any disclaimer, the term of this patent is extended or adjusted under 35 U.S.C. 154(b) by 497 days.

(21) Appl. No.: 14/181,752

(22) Filed: Feb. 17, 2014

(65) Prior Publication Data

US 2014/0230268 A1 Aug. 21, 2014

(30) Foreign Application Priority Data

Feb. 20, 2013 (DE) ..... 10 2013 101 673

(51) Int. Cl.

| | |
|---|---|
| ***F26B 3/00*** | (2006.01) |
| ***F26B 21/08*** | (2006.01) |
| ***A47L 15/00*** | (2006.01) |
| *A47L 15/48* | (2006.01) |
| *A47L 15/42* | (2006.01) |

(52) U.S. Cl.

CPC ..... *F26B 21/083* (2013.01); *A47L 15/0042* (2013.01); *A47L 15/0047* (2013.01); *A47L 15/4234* (2013.01); *A47L 15/481* (2013.01); *A47L 2301/04* (2013.01); *A47L 2501/11* (2013.01); *A47L 2501/30* (2013.01)

(58) Field of Classification Search

CPC ... F26B 21/083; A47L 15/481; A47L 15/4291
See application file for complete search history.

(56) References Cited

U.S. PATENT DOCUMENTS

| | | | | |
|---|---|---|---|---|
| 6,434,857 | B1 * | 8/2002 | Anderson | D06F 25/00 34/128 |
| 2010/0043842 | A1 | 2/2010 | Jerg et al. | |
| 2011/0114141 | A1 * | 5/2011 | Classen | A47L 15/0026 134/56 D |
| 2011/0120511 | A1 * | 5/2011 | Jerg | A47L 15/4251 134/115 R |
| 2011/0197926 | A1 * | 8/2011 | Fauth | A47L 15/4291 134/18 |
| 2011/0203614 | A1 * | 8/2011 | Fauth | A47L 15/0042 134/18 |

FOREIGN PATENT DOCUMENTS

| | | | |
|---|---|---|---|
| DE | 102008038504 | A1 | 2/2010 |
| DE | 102008043548 | A1 | 5/2010 |
| DE | 102008043576 | A1 | 5/2010 |

* cited by examiner

*Primary Examiner* — Jason Lau
(74) *Attorney, Agent, or Firm* — Leydig, Voit & Mayer, Ltd.

(57) ABSTRACT

A method for operating a dishwasher having a sorption drying device includes performing a desorption process using the sorption drying device according to a selected cleaning cycle of the dishwasher. The desorption process is capable of releasing moisture.

18 Claims, 4 Drawing Sheets

DISHWASHER AND METHOD FOR OPERATING A DISHWASHER

CROSS-REFERENCE TO RELATED APPLICATIONS

This application claims priority from German Patent Application No. DE 10 2013 101 673.1, filed Feb. 20, 2013, which is hereby incorporated by reference herein in its entirety.

FIELD

The present invention relates to a method for operating a dishwasher having a sorption drying device. The present invention also relates to a dishwasher suitable for carrying out the operating method.

BACKGROUND

Dishwashers, such as household dishwashers, conventionally use condensation drying to dry the items washed. To this end, in conventional household dishwashers, for example, the wash liquid; i.e., the water contained in the dishwasher, the washing chamber thereabove, and the items to be washed are heated to temperatures of between about 65° C. (degrees Celsius) and 70° C. at the end of the wash cycle after the last water-supplying cycle step, typically the final rinse step. The water vapor given off by the tableware condenses on condensation surfaces, mostly on the inner walls of the washing chamber, and flows into the wash liquid. This method requires a large amount of energy, which is released into the environment and cannot be used further in the process.

Moreover, from German Publication DE 10 2008 038 504 A1, for example, dishwashers having sorption drying devices are known in which air circulating within the washing chamber is passed through a drying agent (also called sorption agent) contained in the sorption drying device and dehumidified. Due to the removal of moisture from the air, the items to be washed can be dried more quickly at lower temperatures, which allows energy savings during the drying process as compared to condensation drying. During a subsequent wash cycle, the moisture taken up by the sorption agent during drying is removed from the sorption drying device during a desorption process and delivered into the washing chamber, and thus returned into the wash liquid. The desorption process requires input of energy in the form of heat. However, the energy input is less than the energy that is saved during the drying process, compared to condensation drying. Consequently, sorption drying allows for a net energy savings compared to condensation drying.

German Publication DE 10 2008 043 576 A1 describes a method for operating a dishwasher having a sorption drying device, where the point in time at which the desorption process is to be carried out is determined based on parameters such as, for example, air temperature and/or water inlet temperature. The method described allows the moisture previously taken up in the sorption drying device to be desorbed as completely and quickly as possible with as little additional energy expenditure as possible.

SUMMARY

In an embodiment, the present invention provides a method for operating a dishwasher having a sorption drying device. The method includes performing a desorption process using the sorption drying device according to a selected cleaning cycle of the dishwasher. The desorption process is capable of releasing moisture.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

In an embodiment the present invention provides a method in which a desorption process of the sorption drying device, which desorption process is capable of releasing moisture, is performed according to a selected cleaning cycle of the dishwasher. In this way, the moisture released by the sorption drying device in the form of vapor during the desorption process can be used to assist the cleaning process. Thus, the sorption drying device is advantageously used as a steam generator for cleaning items to be washed.

It is an aspect of the present invention to provide a method for operating a dishwasher, where the energy used in the desorption process is used, to the extent possible, to enhance the quality of the cleaning process performed. Another aspect is to provide a dishwasher suitable for carrying out the method.

In an advantageous embodiment of the method, the amount of heat input during the desorption process of the sorption drying device is selected according to the selected cleaning cycle of the dishwasher. The heat input can be adjusted by selecting the duration and/or the power input. In another advantageous embodiment of the method, the heat input is also selected according to a previously performed cleaning cycle of the dishwasher. In this way, the amount of moisture contained in the sorption drying device after a previous cleaning cycle can be taken into account to achieve a maximum cleaning effect in the current desorption process.

A dishwasher according to the present invention has a sorption drying device and a controller for controlling cycle sequences and is characterized in that the controller is adapted to perform an operating method according to the present invention. The advantages obtained are those mentioned in connection with the operating method.

Figure 1:
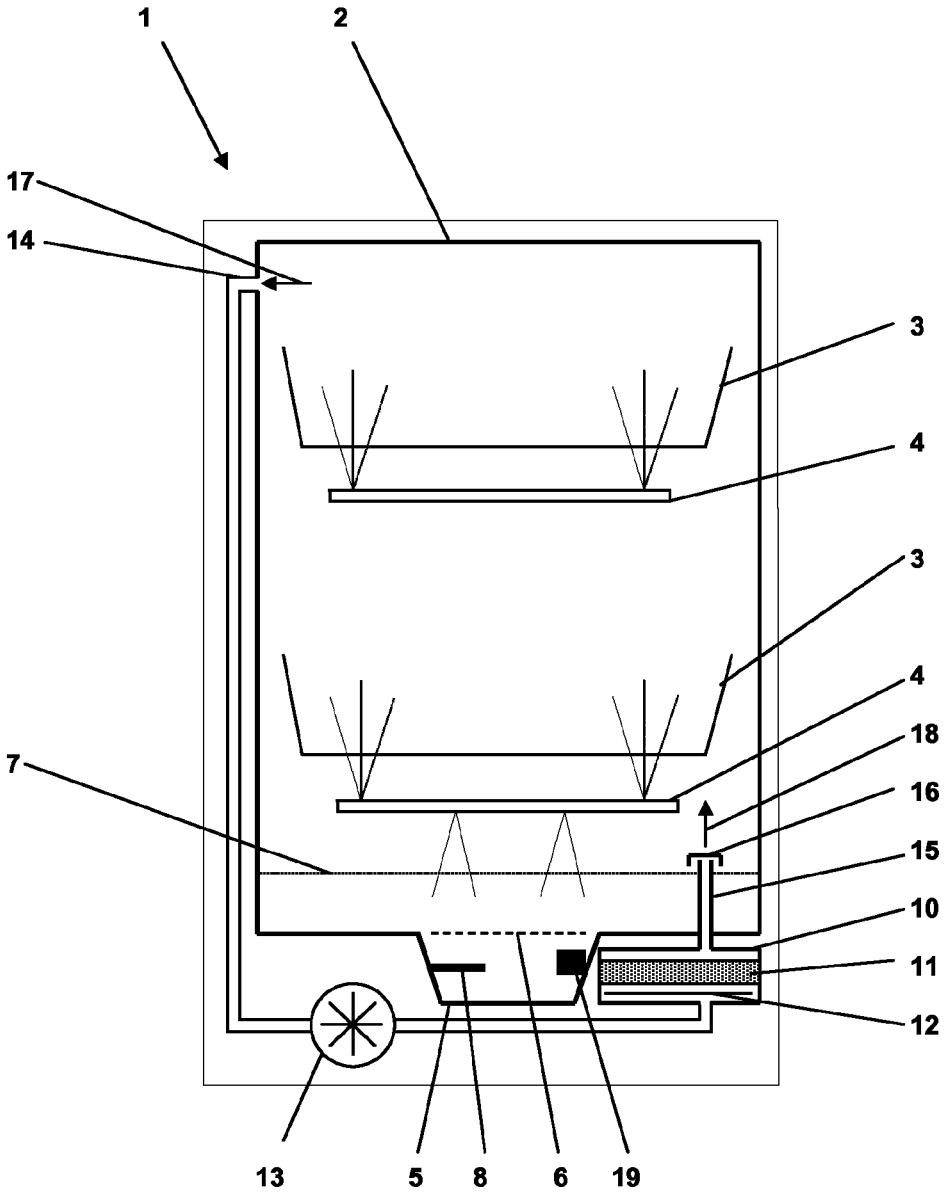
FIG. 1 shows a schematic view of a dishwasher.

FIG. 1 schematically illustrates the configuration of a dishwasher 1 adapted to perform the method according to the present invention. Here, dishwasher 1 is designed as a domestic dishwasher, but the present invention may also be applied in connection with dishwashers for commercial and/or medical use.

Dishwasher 1 has a washing chamber 2 in which dish racks 3 are provided for supporting the items to be washed, such as, for example, dishware, cookware and cutlery. Dishwasher 1 further has spray arms 4 for wetting the items to be washed with a wash liquid 7; i.e., the cleaning liquid present in dishwasher 1. The bottom of washing chamber 2 carries a washing chamber sump 5 having a liquid heater 8 for heating wash liquid 7 and a screen 6 for filtering out detached soil particles. Washing chamber sump 5 further contains a recirculation pump and a drain pump.

A sorption drying device 10, which typically includes a relatively voluminous container made of metal, usually stainless steel, and having a volume of from 2 to 3 liters, is disposed externally of washing chamber 2, preferably in the base assembly below the bottom of washing chamber 2. For the sake of simplification, sorption drying device 10 is hereinafter also referred to as sorption unit 10. Sorption unit 10 is in direct communication with washing chamber 2 via an outlet 15. Outlet 15 has a hat-shaped cover 16, which prevents entry of wash liquid 7 into sorption unit 10.

Sorption unit 10 contains a sorption agent 11, also called sorbent, as well as a desorption heater 12, which serves to heat sorption agent 11, and thus to expel (desorb) the moisture taken up.

In a drying step, in order to remove moisture from washing chamber 2 and from the items washed, a fan 13 draws in moist process air 17 through an inlet 14 preferably disposed in the upper portion of wash chamber 2 and conveys it through sorption unit 10, in which moisture (water vapor) is absorbed by sorption agent 11. In the process, an exothermic reaction takes place in sorption agent 11, heating sorption agent 11 to about 100° C. (degrees Celsius). The dehumidified and heated process air 18 is returned through outlet 15 to washing chamber 2 so as to take up water vapor again therein.

The desorption is performed during a wash step by means of desorption heater 12, which heats sorption agent 11. When fan 13 is operated simultaneously, the moisture bound in sorption agent 11 is conveyed as water vapor into washing chamber 2. Here, the energy contained in the discharged water vapor assists in the heating of wash liquid 7, washing chamber 2, and of the items to be washed. The material used in sorption unit 10 may be, for example, zeolite, which requires a desorption temperature of up to 250° C. Sorption agent 11 is typically disposed in sorption unit 10 in the form of spherical particles in bulk.

Dishwasher 1 further has a soil sensor 19 disposed in the wash circuit. In the exemplary embodiment of FIG. 1, soil sensor 19 is schematically disposed within washing chamber sump 5. Using soil sensor 19, the amount and type of soil detached by wash liquid 7 from the items to be washed are detected, and this information is transmitted to a controller of dishwasher 1. Soil sensor 19 may, for example, take the form of an optical turbidity sensor.

Figure 2:
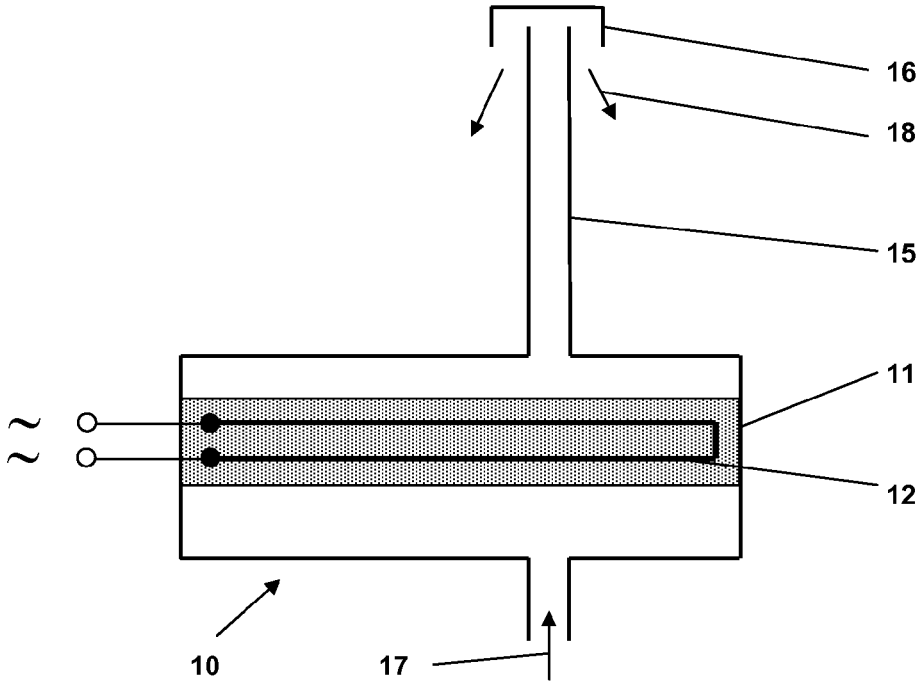
FIG. 2 shows a schematic representation of a sorption drying device for a dishwasher.

FIG. 2 illustrates, in schematic form, the configuration of another exemplary embodiment of a sorption unit 10 which again includes a sorption agent 11, a sorption heater 12, as well as an inlet 17 and an outlet 15, which is protected from entry wash liquid 7 by means of a cover 16. During desorption, fan 13 upstream of inlet 17 (see FIG. 1) is off and desorption heater 12 is on. Especially because of the heat given off by desorption heater 12, sorption agent 11 heats up, and the moisture bound therein is released as water vapor 18 into washing chamber 2. In a departure from the sorption unit 10 of FIG. 1, in the advantageous embodiment shown in FIG. 2, desorption heater 12 is disposed within sorption agent 11 so as to provide the most effective desorption possible.

Figure 3:
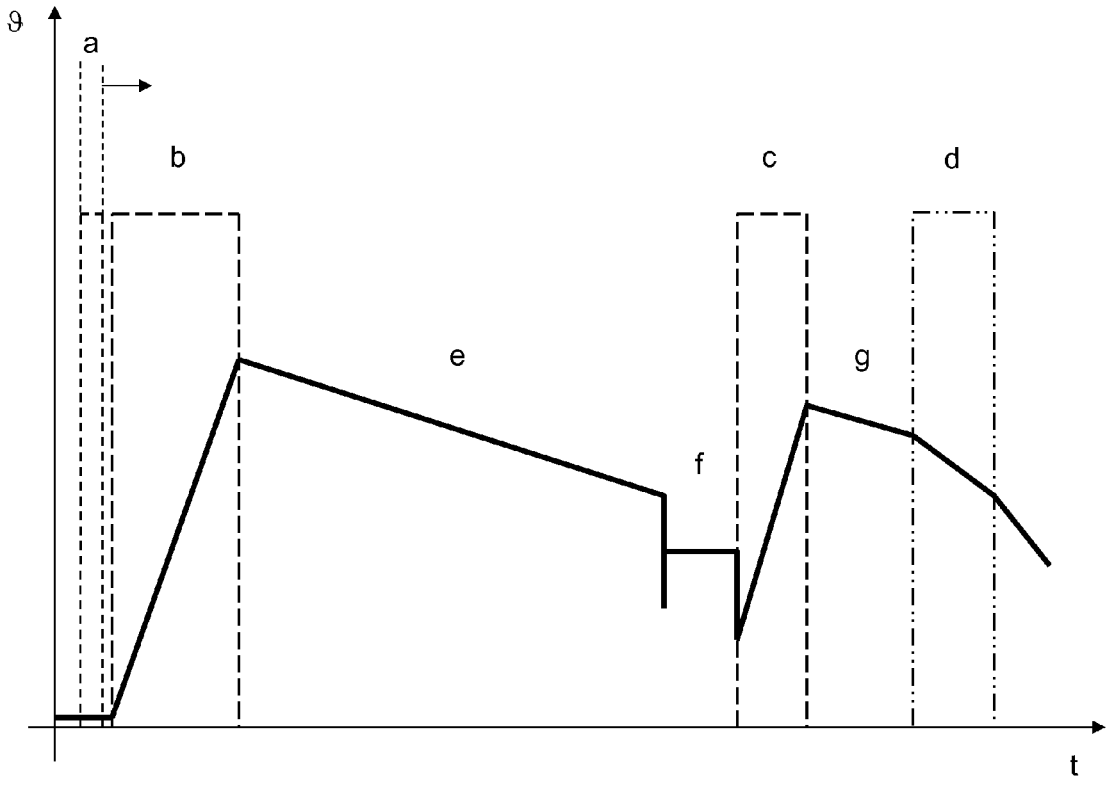
FIG. 3 shows a schematic diagram of the temperature profile and the phases executed in a first exemplary embodiment of an operating method according to the present application.
Figure 4:
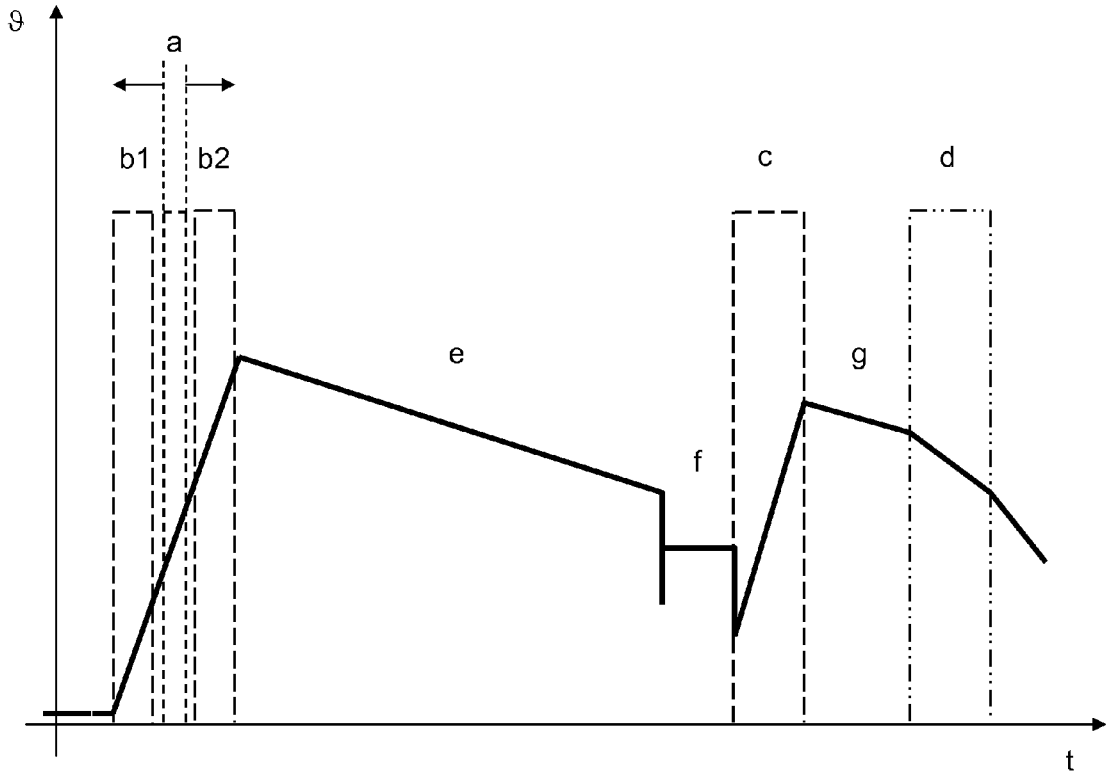
FIG. 4 shows a schematic diagram illustrating the temperature profile and the phases executed in a second exemplary embodiment of an operating method according to the present application.

FIGS. 3 and 4 illustrate two exemplary embodiments of a method for operating a dishwasher according to the present invention. The figures each illustrate the change in the wash liquid temperature over time during various phases of a cleaning cycle. The operating methods illustrated may be performed, for example, by the dishwasher shown in FIG. 1, possibly using the sorption unit shown in FIG. 2. Therefore, these methods will be described below with reference to FIGS. 1 and 2 and the reference numerals used therein.

FIG. 3 schematically illustrates the temperature θ as a function of time t during a wash cycle including sorption drying as a first exemplary embodiment of an operating method according to the present invention. In the diagram, the individual, successively executed phases of the cycle are denoted by lowercase letters a through f.

Prior to a heating phase b of a cleaning process, a desorption process a is performed, in which moisture is expelled from sorption unit 10. In desorption process a, which is also referred to as desorption phase, desorption heater 12 is on, and during heating phase b of the cleaning process, liquid heater 8 is on. Liquid heater 8 heats wash liquid 7 to the cycle-specific nominal temperature.

The heating phase b of a cleaning process is followed by a hold time e of the cleaning process, during which the heated wash liquid 7 is circulated. Wash liquid 7 is replaced for a subsequent intermediate rinse step f. Prior to a heating phase c of a final rinse step, wash liquid 7 is replaced again. During the heating phase c of the final rinse step, liquid heater 8 heats wash liquid 7 to the final temperature of the final rinse step, whereupon, during a hold time g of the final rinse step, wash liquid 7 is only circulated by the recirculation pump. During the final drying phase d, sorption drying is activated, and the moisture is withdrawn from washing chamber 2 and the items washed by means of the activated fan 13, conveyed through sorption agent 11, and stored therein.

In the prior art, the desorption phase has a constant duration. Typically, the aim is to perform the desorption process in the shortest time possible to minimize the energy required for the desorption. This applies especially to the energy-saving cycles used in compliance tests.

In accordance with the present invention, the first embodiment provides that when the user selects, for example, a wash cycle using a high wash temperature, preferably above 55° C., the duration of desorption process a is increased, starting at a minimum or reference value, which is preferably associated with the energy-saving cycle or energy label cycle, while the power input from desorption heater 12 remains the same. One example of a wash cycle that uses a high wash temperature is the so-called "heavy wash cycle", which may have a wash temperature of, for example, 75° C. Due to the longer desorption period a, sorption agent 11 is regenerated to a greater extent, and thus gives off more water vapor. This additional amount of moisture released into washing chamber 2 during desorption phase a results in more intense soaking of the soils on the items to be washed, and ultimately in improved cleaning. Thus, the longer and more intensive desorption is used in the wash cycle for active cleaning. In this sense, sorption unit 10 is used as a steam generator for cleaning purposes. Advantageously, the maximum desorption time of desorption process a is about ten minutes. However, this method requires a sufficient amount of moisture to be absorbed in sorption agent 11, which is usually the case.

Since warm air can take up more moisture than cold air, the absolute amount of moisture introduced into washing chamber 2 is higher in wash cycles with a high average rinse temperature than in cycles with a low rinse temperature. Thus, for example, in a heavy wash cycle, sorption agent 11 takes up more moisture during drying phase d, which would then be available in a subsequent heavy wash cycle for the longer desorption process a.

If, for example, after completion of a full heavy wash cycle, an energy-saving cycle is performed, then sorption agent 11 is not completely regenerated because the desorption period of desorption process a is shorter in the energy-saving cycle, so that residual moisture from the heavy wash cycle remains in sorption agent 11. The residual amount of moisture will be available when needed later, for example, in the desorption phase of a subsequent heavy wash cycle.

However, if a situation should arise where an insufficient amount of moisture is absorbed in sorption agent 11, for example, because a preceding heavy wash cycle, during which all moisture was removed from sorption agent 11, was canceled and, therefore, no drying phase d was carried out during which moisture could have been taken up, then desorption process a may be shortened, and instead the hold time e of the cleaning process may be extended in duration so as to achieve an overall comparable cleaning effect.

In an alternative embodiment, the intensity of desorption process a may be varied instead of its duration, for example, by operating desorption heater 12 at a higher power.

FIG. 4 shows, analogously to FIG. 3, a second embodiment of an operating method according to the present invention. In this embodiment, in addition to the cycle-specific adjustment of the duration (or intensity) of desorption process a, this cycle step is shifted to the heating phase of the cleaning process. Thus, the heating phase of the cleaning process is divided into two heating sub-phases b1, b2, between which desorption process a is performed.

Preferably, this cycle adaptation is performed in the so-called "sensor wash cycle", in which soil sensor 19 is polled. It is not until soil sensor 19 determines the soil level of the items to be washed, which may be at the earliest several (e.g., ten) minutes after the beginning of the heating phase b of the cleaning process, that the controller of dishwasher 1 can decide which temperature θ is to be reached in the heating phase of the cleaning process. As in the first exemplary embodiment, the duration of desorption phase a then depends on the final value of the wash temperature. Since the sensor wash cycle is quite frequently used in practice, the advantages of the present invention are particularly effective in this connection. The desorption time is here preferably between five and ten minutes.

It is to be understood that the present invention is not limited to the two exemplary embodiments mentioned herein. For example, it is expedient to completely omit the desorption in wash cycles for sensitive items, such as, in the glassware cycle, or to significantly shorten this process relative to the reference value in the so-called "delicate wash cycle". Otherwise, the water vapor released could promote glass corrosion. In all cases, however, the desorption level is determined according to the cleaning cycle.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 dishwasher
2 washing chamber
3 dish rack
4 spray arm
5 washing chamber sump
6 screen
7 wash liquid
8 liquid heater
10 sorption unit
11 sorption agent or sorbent
12 desorption heater or heating means
13 fan
14 inlet
15 outlet
16 cover
17 process air, moist
18 process air, heated, dry
19 soil sensor
a desorption process
b heating phase of the cleaning process
b1, b2 heating sub-phases of the cleaning process
c heating phase of the final rinse step
d sorption phase or drying phase
e hold time of the cleaning process
f intermediate rinse step
g hold time of the final rinse step

What is claimed is:

1. A method for operating a dishwasher having a liquid heater and a sorption drying device including a desorption heater, the method comprising:

heating, using the liquid, heater, wash liquid to be circulated in a washing chamber of the dishwasher, performing a desorption process using the sorption drying device according to a selected type of cleaning cycle of the dishwasher, the desorption process being capable of releasing moisture, wherein a cleaning cycle comprises a plurality of program steps including cleaning, rinsing, and drying, and wherein the amount of heat input by the desorption heater during the desorption process is selected according to the selected type of cleaning cycle of the dishwasher.

2. The method recited in claim 1, wherein the heat input by the desorption heater is adjusted by selecting at least one of a duration or a power input.

3. The method recited in claim 1, wherein the sorption drying device is used to function as a steam generator for cleaning items to be washed.

4. The method recited in claim 1, wherein the desorption process is performed at a beginning of a heating phase of a cleaning process.

5. The method recited in claim 1, wherein the desorption process is performed between two heating sub-phases of a cleaning process.

6. The method recited in claim 1, wherein the amount of heat input by the desorption heater during the desorption process is selected according to a previously performed type of cleaning cycle of the dishwasher.

7. A dishwasher comprising:

a liquid heater configured to heat wash liquid to be circulated in a wash in chamber of the dishwasher and a sorption drying device including a desorption heater; and a controller for controlling cycle sequences in the dishwasher, the controller being adapted to control the sorption drying device to perform a desorption process according to a selected type of cleaning cycle of the dishwasher, the desorption process being capable of releasing moisture, wherein a cleaning cycle comprises a plurality of program steps including cleaning, rinsing, and drying, and wherein the amount of heat input by the desorption heater during the desorption process is selected according to the selected type of cleaning cycle of the dishwasher.

8. The dishwasher recited in claim 7, wherein the heat input by the desorption heater is adjusted by selecting at least one of a duration or a power input.

9. The dishwasher recited in claim 7, wherein the sorption drying device is adapted to function as a steam generator for cleaning items to be washed.

10. The dishwasher recited in claim 7, wherein the desorption process is performed at a beginning of a heating phase of a cleaning process.

11. The dishwasher recited in claim 7, wherein the desorption process is performed between two heating sub-phases of a cleaning process.

12. The dishwasher recited in claim 7, wherein the amount of heat input by the desorption heater during the desorption process is selected according to a previously performed type of cleaning cycle of the dishwasher.

13. A method for operating a dishwasher having a sorption drying device, the method comprising:

performing a desorption process using the sorption drying device according to a selected cleaning cycle of the dishwasher, the desorption process being capable of releasing moisture, wherein a cleaning cycle comprises a plurality of program steps including cleaning, rinsing, and drying, and wherein the amount of heat input during the desorption process is selected according to a previously performed cleaning cycle of the dishwasher.

14. A dishwasher comprising:

a sorption drying device; and a controller for controlling cycle sequences in the dishwasher, the controller being adapted to control the sorption drying device to perform a desorption process according to a selected cleaning cycle of the dishwasher, the desorption process being capable of releasing moisture, wherein a cleaning cycle comprises a plurality of program steps including cleaning, rinsing, and drying, and wherein the amount of heat input during the desorption process is selected according to a previously performed cleaning cycle of the dishwasher.

15. A method for operating a dishwasher having a sorption drying device, the method comprising:

performing a desorption process using the sorption drying device according to a selected cleaning cycle of the dishwasher, the desorption process being capable of releasing moisture, wherein a cleaning cycle comprises a plurality of program steps including cleaning, rinsing, and drying, wherein the amount of heat input during the desorption process is selected according to the selected cleaning cycle of the dishwasher, and wherein the amount of heat input during the desorption process is selected according to a previously performed. cleaning cycle of the dishwasher.

16. A dishwasher comprising:

a sorption drying device; and a controller for controlling cycle sequences in the dishwasher, the controller being adapted to control the sorption drying device to perform a desorption process according to a selected cleaning cycle of the dishwasher, the desorption process being capable of releasing moisture, wherein a cleaning cycle comprises a plurality of program steps including cleaning, rinsing, and drying, wherein the amount of heat input during the desorption process is selected according to the selected cleaning cycle of the dishwasher, and wherein the amount of heat input during the desorption process is selected according to a previously performed cleaning cycle of the dishwasher.

17. The method recited in claim 1, wherein the selected type of cleaning cycle comprises one of energy-saving, heavy wash, automatic, and fine.

18. The dishwasher recited in claim 7, wherein the selected type of cleaning cycle comprises one of energy-saving, heavy wash, automatic, and fine.

* * * * *